US006014538A

United States Patent [19]

Imamiya et al.

[11] Patent Number: 6,014,538

[45] Date of Patent: Jan. 11, 2000

[54] CLEANING DEVICE FOR CLEANING COPY MACHINE COMPONENT

[75] Inventors: Koji Imamiya, Kawasaki; Goro Oda, Yokosuka, both of Japan

[73] Assignees: Toshiba Tec Kabushiki Kaisha, Tokyo; Kabushiki Kaisha Toshiba, Kawasaki, both of Japan

[21] Appl. No.: 09/271,325

[22] Filed: Mar. 18, 1999

[30] Foreign Application Priority Data

Mar. 19, 1998 [JP] Japan ..... 10-070553

[51] Int. Cl.[7] ..... G03G 15/20

[52] U.S. Cl. ..... 399/327; 15/252.52

[58] Field of Search ..... 399/326, 327, 399/352, 71; 15/256.52, 256.51

[56] References Cited

U.S. PATENT DOCUMENTS 3,883,921 5/1975 Thettu et al. ..... 399/327 X 5,850,588 12/1998 Yoshikawa ..... 399/327

FOREIGN PATENT DOCUMENTS 58-182670 10/1983 Japan .

*Primary Examiner*—Susan Lee

*Attorney, Agent, or Firm*—Foley & Lardner

[57] ABSTRACT

A fixing device of a copy machine has a pair of rollers for transporting a paper sheet having a toner image held thereon by sandwiching it therebetween and for heating and pressurizing the toner image to fix it on the paper sheet. A cleaning device for cleaning remaining toner is arranged so as to face the surface of the fixing roller. The cleaning device has a cylinder having a slit extended in a shaft direction in the outer periphery, a feed-out shaft and a rewind shaft arranged within the cylinder, a web fed out from the feed-out shaft through the slit wound around the outer periphery of the cylinder and rewind by the rewind shaft within the cylinder again through the slit. The cleaning device is arranged in such a way that a part of the web wound around the outer periphery of the cylinder is in contact with the surface of the fixing roller.

16 Claims, 4 Drawing Sheets

CLEANING DEVICE FOR CLEANING COPY MACHINE COMPONENT

BACKGROUND OF THE INVENTION

The present invention relates to a cleaning device for cleaning an object to be cleaned by sliding a cleaning member in contact with the object, and more particularly, a cleaning device for cleaning the object by sliding a belt-form web in contact with the object.

As a conventionally-used cleaning device for cleaning the object by sliding the cleaning member in contact with the object, known is a cleaning device for cleaning unfixed toner undesirably attached onto a surface of a fixing roller (incorporated in a fixing device of a copy machine) by sliding a belt-form web in contact with the surface.

The cleaning device of this type has a feed-out shaft around which the belt-form web is wound, a rewind shaft for rewinding the web fed out from the feed-out shaft, a pressing member for pressing the portion of the web, which is fed out from the feed-out shaft to the rewind shaft, against the surface of the fixing roller. All of the feed-out shaft, the rewind shaft, the web, and the pressing member are integrally housed in a case.

While the copy machine is in operation, the web is pressed against the surface of the rotating fixing roller by the pressing member, thereby cleaning the unfixed toner attached onto the surface of the fixing roller. After completion of a series of copy operations, the web is fed out from the feed-out shaft by a predetermined length and rewound by the rewind shaft. In this way, an unused portion of the web is pressed against the surface of the fixing roller by the pressing member.

However, in the conventional cleaning device mentioned above, when a relatively large amount of toner is attached onto the surface of the fixing roller, more specifically, when a paper jam occurs, it is impossible for the normal cleaning operation mentioned above to clean the surface of the fixing roller completely. In this case, a problem is raised during the next copying operation. A copy image output on a medium is spoiled.

BRIEF SUMMARY OF THE INVENTION

The present invention is made in view of the aforementioned problem. An object of the present invention is to provide a cleaning device capable of providing a sufficient cleaning performance by a simple device structure.

To attain the aforementioned object, the cleaning device of the present invention comprising:

a cylindrical member having a slit extended in a shaft direction, in the outer periphery thereof;

a cleaning member of a belt form wound around the outer periphery of the cylindrical member;

a feed-out shaft extended in the shaft direction within the cylindrical member and having the cleaning member wound therearound, for feeding out the cleaning member wound; and a rewind shaft extended in the shaft direction within the cylindrical member, for rewinding the cleaning member which fed out from the feed-out shaft, extended out of the cylindrical member through the slit, wound around the outer periphery of the cylindrical member, and introduced again into the cylindrical member through the slit.

In another aspect, the cleaning device of the present invention comprises a cylindrical member having a slit extended in a shaft direction, in the outer periphery thereof;

a cleaning member of a belt form wound around the outer periphery of the cylindrical member;

a feed-out shaft extended in the shaft direction within the cylindrical member and having the cleaning member wound therearound, for feeding out the cleaning member wound;

a rewind shaft extended in the shaft direction within the cylindrical member, for rewinding the cleaning member which fed out from the feed-out shaft, extended out of the cylindrical member through the slit, wound around the outer periphery of the cylindrical member, and introduced again into the cylindrical member through the slit;

pressing means for urging the cylindrical member for pressing a part of the cleaning member wound around the outer periphery of the cylindrical member against an object to be cleaned; and rotating means for rotating the rewind shaft to rewind the cleaning member and moving the cleaning member pressed against the object to be cleaned by the pressing means.

In a further aspect, the cleaning device comprising:

a cylindrical member having a slit extended in a shaft direction, in the outer periphery thereof;

a cleaning member of a belt form wound around the outer periphery of the cylindrical member;

a feed-out shaft extended in the shaft direction within the cylindrical member and having the cleaning member wound therearound, for feeding out the cleaning member wound;

a rewind shaft extended in the shaft direction within the cylindrical member, for rewinding the cleaning member which fed out from the feed-out shaft, extended out of the cylindrical member through the slit, wound around the outer periphery of the cylindrical member, and introduced again into the cylindrical member through the slit, pressing means for urging the cylindrical member for pressing a part of the cleaning member wound around the outer periphery of the cylindrical member against an object to be cleaned;

rotation prohibit means for prohibiting rotation of the cylindrical member pressed against the object to be cleaned by the pressing means to align the cylindrical member with the object to be cleaned; and rotating means for rotating the rewind shaft to rewind the cleaning member and moving the cleaning member pressed against the object to be cleaned by the pressing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, embodiments of the present invention will be explained in detail with reference to the drawings.

Figure 1:
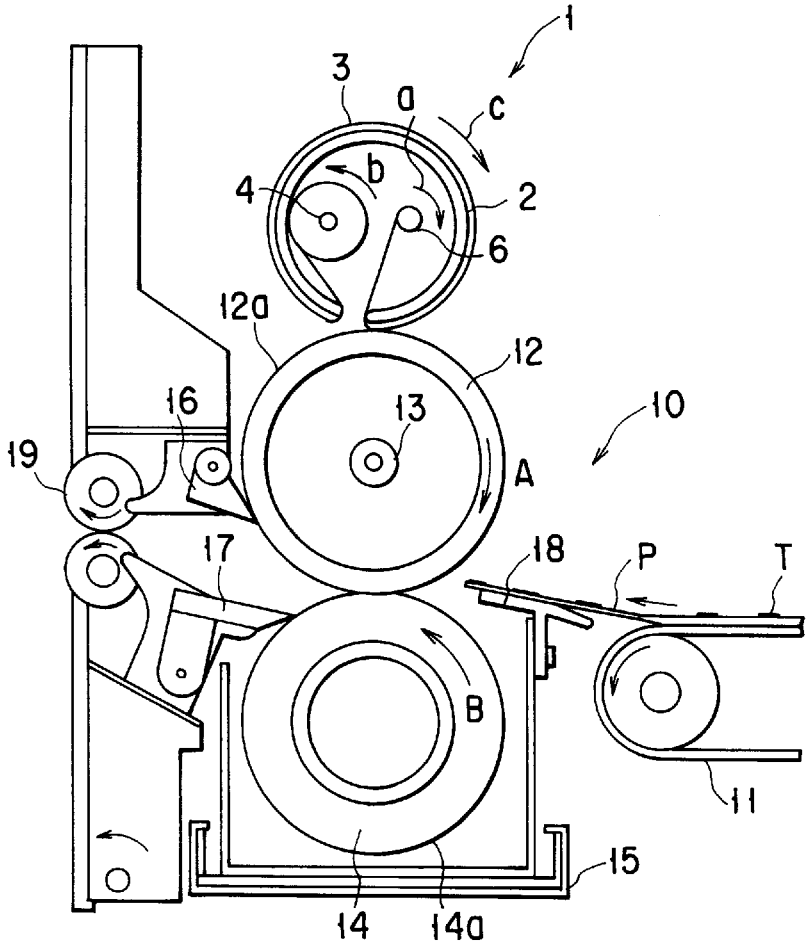
FIG. 1 is a cross sectional view of a fixing device having a cleaning device of the present invention.
Figure 2:
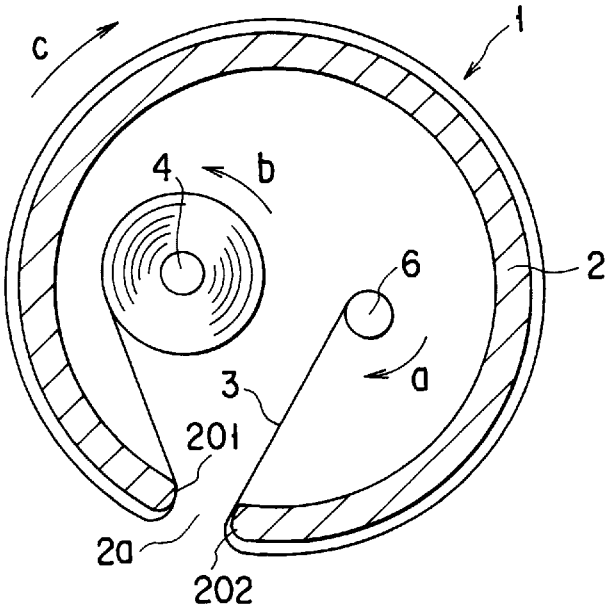
FIG. 2 is a magnified cross sectional view of the cleaning device of FIG. 1.

FIG. 1 shows a cross sectional view of a cleaning device 1 according to an embodiment of the present invention for cleaning a surface 12*a* of a fixing roller 12 of a fixing device 10 which is to be incorporated in a generally used copy machine. In FIG. 2, the cross sectional view of the cleaning device 1 is magnified.

As shown in FIG. 1, the fixing device 10 has a fixing roller 12 having a heater lamp 13 co-axially arranged therein, and a pressurizing roller 14 made of rubber. The pressurizing roller 14 is arranged under the fixing roller 12 so as to press the fixing roller 12 at a predetermined pressure upwardly therefrom. Exfoliate claws 16, 17 are respectively arranged downstream of a nip point between the rollers 12 and 14 in touch with the roller surfaces 12*a*, 14*a*. The paper P is exfoliated from the roller surfaces 12*a*, 14*a* by means of the exfoliate claws 16, 17.

When the paper sheet P having a toner image T transferred thereon in a well-know electrophotographic process is fed into the fixing device 10 by way of a transfer belt 11 and a guide member 18 immobilized at a case 15, a leading edge of the paper sheet P is sandwiched between the rollers 12 and 14, and then the whole paper sheet P is passed through the nip between the rollers 12 and 14. During this process, the toner image T held on the paper sheet P is fused and fixed on the paper sheet P. The paper sheet P having the toner image T thus fixed thereon is exfoliated from the roller surfaces 12*a* and 14*a* with the assistance of the exfoliate craws 16, 17, and then, discharged out of the machine by way of a pair of discharge rollers 19. Note that a series of processes mentioned above is performed at a speed of 127 mm/sec in this embodiment.

In this case, a slight amount of toner is left unfixed to the paper sheet P and undesirably attached onto the surface 12*a* of the fixing roller 12. In particular, when a paper jam takes place in the fixing device 10, a relatively large amount of unfixed toner is attached onto the surface 12*a* of the fixing roller 12 after the paper sheet P is removed. If a large amount of unfixed toner is attached onto the fixing roller surface 12*a* as mentioned, the unfixed toner will spoil the following paper sheet to be fed.

To overcome this problem, in this embodiment, the cleaning device 1 is arranged so as to face the fixing roller surface 12*a* for cleaning the unfixed toner attached onto the surface 12*a* of the fixing roller 12. FIG. 1 shows the cleaning device 1 which is arranged above the fixing roller 12 so as to face it. However, the cleaning device 1 may be arranged at any place as long as it can face the surface 12*a* of the fixing roller 12.

As shown in the magnified view of FIG. 2, the cleaning device 1 has an aluminum cylinder 2 having virtually the same length in a shaft direction as the fixing roller 12 and an outer diameter of 51 mm (the outer diameter of the fixing roller is 50 mm). A slit 2*a* is formed longitudinally along the cylinder 2 in the outer periphery thereof (in parallel with the leading edge of the paper sheet). Opening edges 201, 202 of the slit 2*a* are round off in order to facilitate the movement of the web described later. Note that rollers (not shown) extending along the shaft direction and rotated by the movement of the web, may be fitted to the opening edges 201, 202 of the slit 2*a*.

In the cylinder 2, a feed-out shaft 4 and a rewind shaft 6 are arranged. Around the feed-out shaft 4, a sufficiently long belt-form web 3 formed of a non-woven cloth, paper, cloth, or felt, is wound. The web 3 fed out from the feed-out shaft 4 is rewound by he rewind shaft 6. The feed-out shaft 4 and the rewind shaft 6 are rotatably arranged and extended in parallel with a center axis of the cylinder 2. The web 3 wound around the feed-out shaft 4 is fed out from the feed-out shaft 4 in the direction indicated by an arrow b (counterclockwise) in the figure. The web 3 is fed out of the cylinder 2 via the opening edge 201 of the slit 2*a*, wound in the direction indicated by an arrow c (clockwise) along the outer periphery of the cylinder 2, and then fed into the cylinder 2 via the opening edge 202 of the slit 2*a*. The web 3 is finally rewound by the rewind shaft 6 in the direction indicated by an arrow a (clockwise) shown in the figure.

In the cleaning device 1 constructed as described above, the cylinder 2 is arranged at a position such that the opening edge 202 of the slit 2*a* (from which the web 3 wound around the outer periphery of the cylinder 2 is fed into the cylinder 2) comes in the closest proximity with the surface 12*a* of the fixing roller 12. With this arrangement of the cleaning device 1, the portion of the web 3 to be slid in contact with the surface 12*a* of the fixing roller 12, can be immediately withdrawn into the cylinder 2 only by slightly rotating the rewind shaft 6. As a result, the entire exposed portion of the web 3 along the outer periphery of the cylinder 2 is rendered always clean. During a normal operation period of the copy machine, the web 3 is wound intermittently by 0.1 mm to 5 mm every time the copy operation is completed. In this embodiment, the web 3 is rewound by 0.5 mm every time a single paper sheet P is fed. In the following explanation, the position of the cleaning device 1 shown in FIG. 1 is regarded as a standard position.

Figure 3:
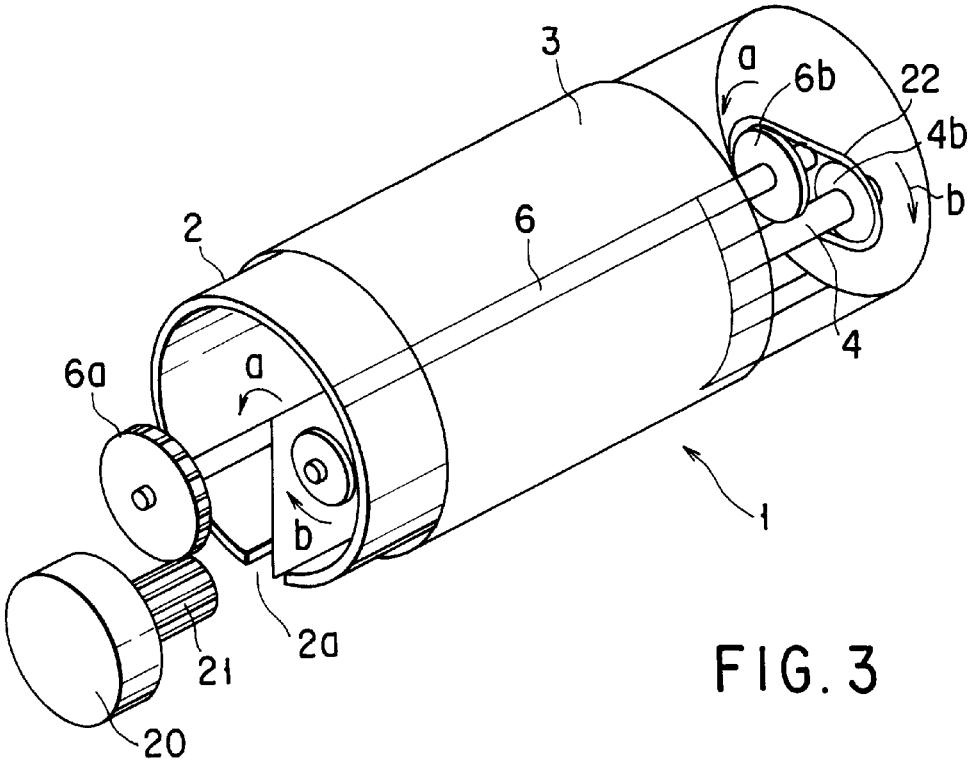
FIG. 3 is a partial perspective view of the cleaning device of FIG. 2.

FIG. 3 schematically shows the mechanism for rewinding the web 3.

At an end of the rewind shaft 6 extended from the cylinder 2, a gear 6*a* is fitted. The gear 6*a* is engaged with a gear 21 fitted to a rotation shaft of a variable-speed motor 20. When the motor 20 is driven in this state, the rewind shaft 6 is rotated in the direction indicated by the arrow a, thereby rewinding the web 3. In this case, the web 3 wound around the feed-out shaft 4 is fed out in the direction indicated by the arrow b and rewound by the rewind shaft 6 by way of the outer periphery of the cylinder 2 and the slit 2*a*.

To the other end of the rewind shaft 6 and to an end of the feed-out shaft 4 both being placed adjacent to each other, pulleys 6*b* and 4*b* are fitted, respectively. An endless rubber belt 22 is stretched between the pulleys 4*b* and 6*b* with a predetermined tension. Since the rotational direction (direction indicated by the arrow b) of the feed-out shaft 4 is opposite to that of the rewind-shaft (direction indicated by the arrow a), when the rubber belt 22 is driven by the rotation of the rewind shaft 6, the rubber belt 22 slides along the pulley 4*b*, with the result that rotational force working in an opposite direction of the rotational direction of the feed-out shaft 4, is given to the feed-out shaft 4. In this way, the web 3 is always stretched between the feed-out shaft 4 and the rewind shaft 6 without the slack.

Figure 4:
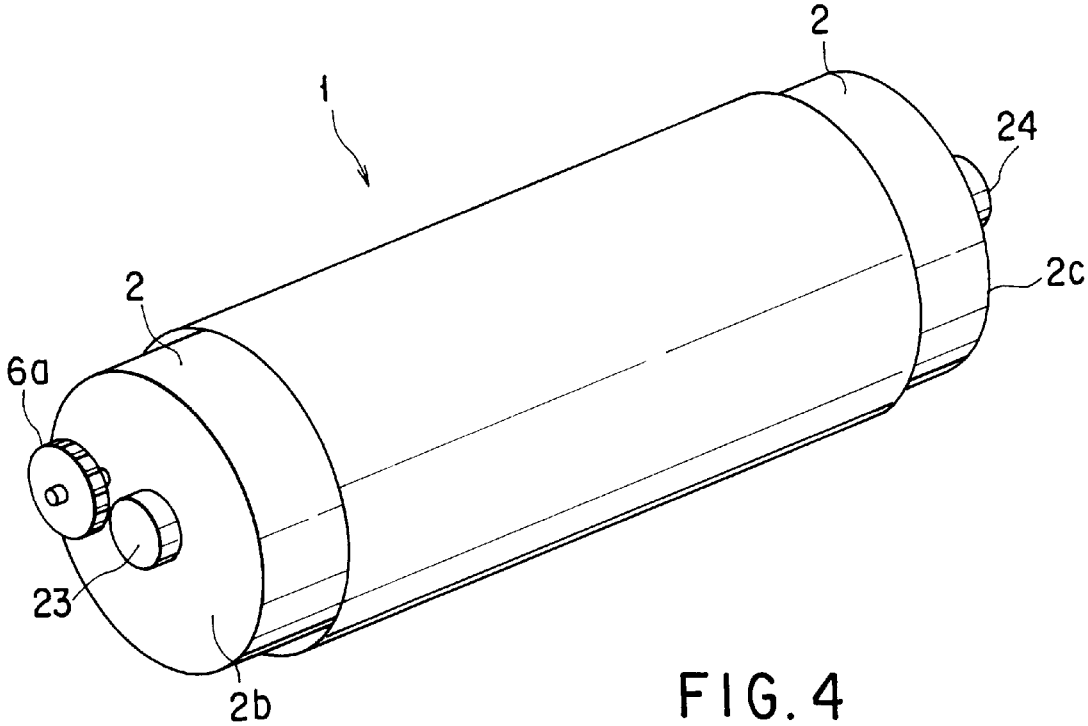
FIG. 4 is a perspective view showing an appearance of the cleaning device of FIG. 2.

As shown in FIG. 4, flanges 2*b*, 2*c* are arranged at both ends of the cylinder 2 in a longitudinal direction. Rotation shafts 23, 24 of the cylinder 2 are formed respectively on the flanges 2*b* and 2*c*. A hole is formed through the flange 2*b* in order to allow one end of the rewind shaft 6 to expose therethrough. The cleaning device 1 thus constructed is detachably arranged in the fixing device 10 by means of the rotation shafts 23, 24 respectively provided at both ends thereof.

The remainder of the web 3 wound around the feed-out shaft 4 can be detected by monitoring a power supply time of the motor 20 and the number of steps (in the case of a stepping motor) on the basis of the whole length of the web 3 and winding speed (rotation speed of the motor 20). Accordingly, when the power supply time of the motor 20 or the number of steps reaches a predetermined value, the message "no cleaning web" is displayed in the display panel (not shown). By the message, a user or a maintenance worker is urged to exchange the cleaning device 1.

Figure 5:
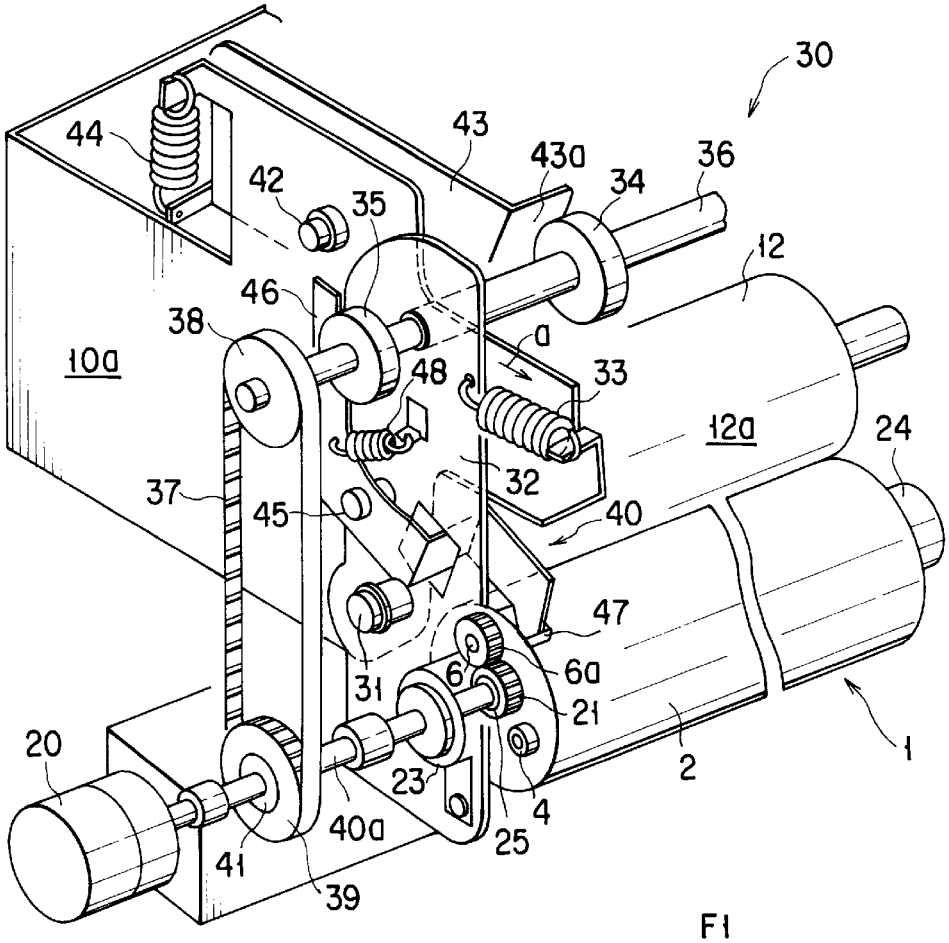
FIG. 5 is a schematic view for explaining a press mechanism for pressing the cleaning device against a fixing roller, and a ratchet mechanism for interrupting the rotation of the cylinder of the cleaning device.

FIG. 5 schematically shows a press mechanism 30 arranged while pressing the cleaning device 1 against the surface 12*a* of the fixing roller 12, and a ratchet mechanism 40 for restricting rotation of the cylinder of the cleaning device 1. In FIG. 5, the cleaning device 1 is arranged sideward below the fixing roller 12 while pressing against the fixing roller 12 upwardly. However, the cleaning device 1 may be positioned as shown in FIG. 1. The cleaning device 1 may be positioned at any place as long as the positional relationship of the cleaning device 1 to the fixing roller 12 shown in FIG. 1 is maintained. Note that the pressing force of the cleaning device 1 against the fixing roller 12 can be controlled in two steps, as described later.

The press mechanism 30 has a movable frame 32 of virtually a rectangular plate rotatably arranged around a pin 31 fixed at a frame 10*a* of the fixing device 10. A spring 33 is attached upward away from the pin 31 so as to be stretched between the frame 10*a* and the movable frame 32. The movable frame 32 is always urged around the pin 31 in the direction indicated by an arrow a by the function of the spring 33. Furthermore, the rotation shaft 23 of the cleaning device 1 is rotatably fixed to a position near the lower end of the movable frame 32. The cleaning device 1 fixed to the movable frame 32 is pressed against the surface 12*a* of the fixing roller 12 by pressing force due to restoration force of the spring 33. The same mechanism (not shown in FIG. 5) is provided with respect to the rotation shaft 24 arranged at the opposite side of the cleaning device 1. In this embodiment, the spring 33 is selected so as to press the cleaning device 1 against the fixing roller 12 with a pressing force of 15N (newton).

Near the upper end of the movable frame 32, a movable rod 36 is rotatably arranged. To the movable rod 36, two eccentric rollers 34, 35 are fixed at a distance in a shaft direction (longitudinal direction). A toothed pulley 38 is fixed to an end of the movable rod 36. A toothed endless belt 37 is wound around the pulley 38. The toothed endless belt 37 is also wound around a toothed pulley 39. Thus the toothed endless belt 37 is stretched between the pulley 38 and 39. The pulley 39 is fixed at a rotation shaft 40*a* of the variable speed motor 20 movable in both forward and backward directions via a one-way clutch 41.

When the motor 20 is rotated in a first direction (forward direction), the driving force is transmitted through the toothed pulley 39, the toothed belt 37, and the toothed pulley 39 to rotate the movable rod 36. On the other hand, when the motor 20 is rotated reversely in a second direction (backward direction to the first direction), the pulley 39 is idled by the function of the one-way clutch 41, with the result that the movable rod 36 would not be rotated.

When the motor 20 is moved backward, the rotation force is transmitted to the rewinding shaft 6 by way of a gear 21 and a gear 6*a* to rewind the web 3, as explained in FIG. 3. Since the gear 21 is fitted to the rotation shaft 40*a* by way of the one-way clutch 25 which is responsible for transmitting the driving force generated only when the motor 20 is rotated backward, the gear 21 would not be rotated when the motor 20 is rotated in a forward direction.

Furthermore, the rotation shaft 23 (24) of the cylinder 2 is rotatably attached to the rotation shaft 40*a* of the motor 20. Therefore, the cylinder 2 is not rotated by the rotation of the motor 20 but driven by the fixing roller 12.

The eccentric roller 34 fixed at the movable rod 36 moves a moving piece 43 which is rotatable to a pin 42 and fixed to the frame 10*a*. Furthermore, an inclined working surface 43*a* is formed at a portion of the moving piece 43 facing the eccentric roller 34. A spring 44 is fitted to a portion of the moving piece 43 apart from the eccentric roller 34 so as to stretch between the moving piece 43 and the frame 10*a*.

When the movable rod 36 is rotated and drives the rotation of the eccentric roller 34, the working surface 43*a* is pressed by the eccentric roller 34. Then, the moving piece 43 is rotated against the restoration force of the spring 44. At this time, the eccentric roller 34 is pressed backward by counter force from the working surface 43*a*. The pressing force is then transmitted to the movable frame 32 through the movable rod 36, with the result that the movable frame 32 is urged in the direction indicated by the arrow a. The urging force acts as the pressing force of the cleaning device 1 against the fixing roller 12. In short, when the motor 20 is rotated forward, a pressing force larger than the pressing force due to the restoration force of the spring 33 mentioned above is applied to the cleaning device 1. Incidentally, in this embodiment, the spring 44 is selected so as to press the cleaning device 1 against the fixing roller 12 with a pressing force of 150N (newton).

On the other hand, the eccentric roller 35 fixed onto the movable rod 36 moves a moving arm 46 arranged rotatably around a pin 45 which is fixed onto the frame 10*a*. To the remotest end portion of the moving arm 46 from the portion with which the eccentric roller 35 is in contact, a pad 47 is attached. The pad 47 is to be pressed into a recess (not shown) formed in a predetermined position of the outer periphery of the cylinder 2 of the cleaning device 1. Between the moving arm 46 and the movable frame 32, a spring 48 is stretched so as to urge the moving arm 46 in a direction to press the pad 47 against the recess formed in the outer periphery of the cylinder 2. The ratchet mechanism 40 is comprised of the eccentric roller 35, the moving arm 46, the pad 47, and the spring 48. Note that the recess to be formed in the outer periphery of the cylinder 2 is positioned at the standard position, which is the position in which the cylinder 2 takes a position shown in FIG. 1 to the fixing roller 12 when the pad 47 is working (that is, the cylinder 2 is stopped).

When the movable rod 36 is rotated and then the eccentric roller 35 of the ratchet mechanism 40 is rotated, the moving arm 46 is rotated against the restoration force of the spring 48. It follows that the pad 47 fixed at an end of the moving arm 46 is removed from the pressing position (recess) on the outer peripheral surface of the cylinder 2. In other words, when the motor 20 moves forward, the cylinder 2 of the cleaning device 1 is allowed to move free.

While the rotation of the cylinder 2 is prohibited by the ratchet mechanism 40 by pressing the cylinder 2 against the surface 12*a* of the fixing roller 12 with the pressing force of 15N by means of the pressing mechanism 30 without rotating the motor 20, even if 10,000 sheets of A-4 size paper were fed through the copy machine and allowed an image to emerge at a printing rate of 5%, the discharged sheet P was not spoiled with toner.

Now, we will explain how to operate the cleaning device 1 constituted as described above.

When a paper jam occurs in the fixing device 10, a larger amount of toner than usual is assumed to be attached on the surface 12*a* of the fixing roller 12 after overcoming the paper jam. In the case where the fixing roller 12 having a larger amount of toner than usual attached thereto is cleaned, the toner cannot be cleaned completely in a normal cleaning manner as mentioned above (the web 3 is intermittently fed while the rotation of the cylinder 2 is prohibited). In this case, the following cleaning operation which is improved in the cleaning performance should be employed.

Figure 6:
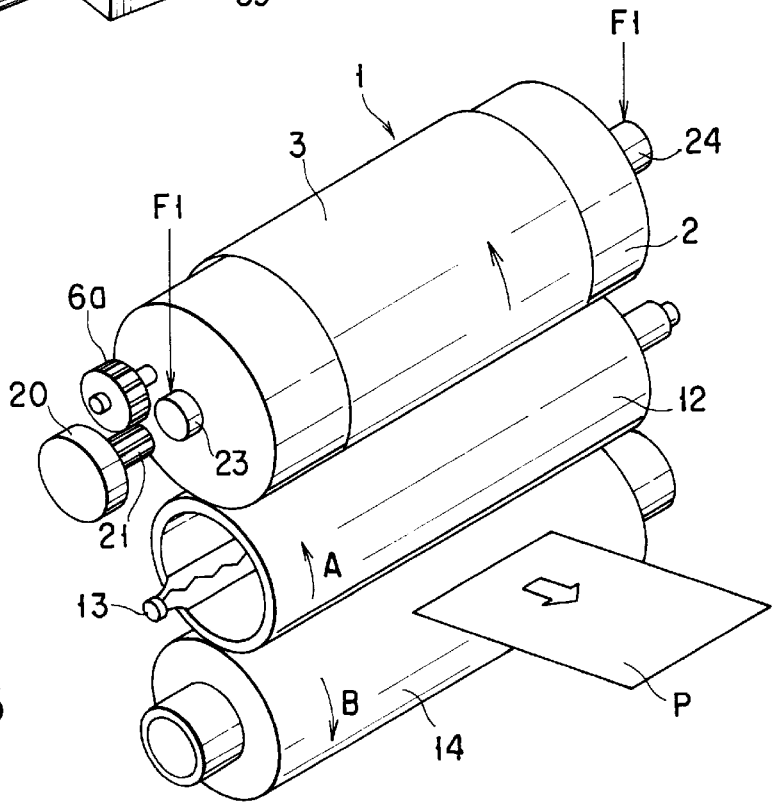
FIG. 6 is a view for explaining a cleaning operation according to a first mode.
Figure 7:
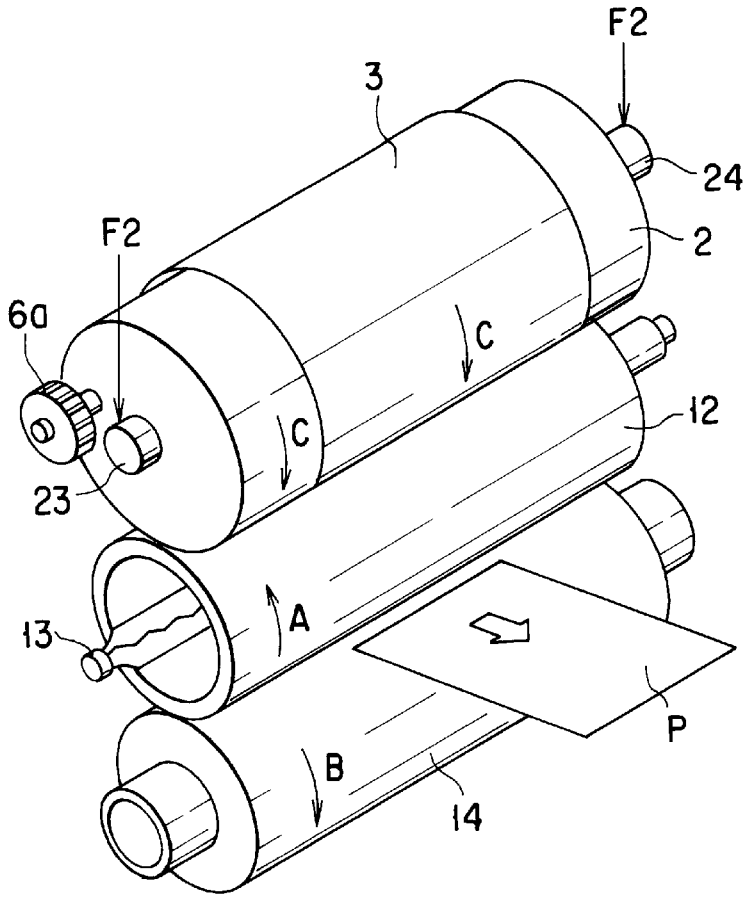
FIG. 7 is a view for explaining a cleaning operation according to a second mode.

In a first mode of the cleaning operation, the motor 20 is moved backward from the initial state shown in FIG. 1 in which the rotation of the cylinder 2 is prohibited by the ratchet mechanism 40 while the cylinder 2 is pressed against the fixing roller 12 by the pressing force F1 (15N). As a result, the web 3 is continuously run (FIG. 6). The web 3 runs in an opposite rotation direction of the fixing roller surface 12*a* along which the web is slid in contact therewith, as shown in FIG. 1 and FIG. 2. At this time, the rotation speed of the motor 20 is set in such a way that a running speed of the web 3 falls within the range of 5 to 200 mm/sec. The power is supplied to the motor 20 for the time required for the fixing roller 12 to rotate at least one rotation (about 1.24 sec).

When the cleaning device 1 was moved in accordance with the first mode, the toner attached to the fixing roller surface 12*a* in a large amount due to the paper jam was successfully cleaned.

In a second mode, the motor 20 is moved forward from the initial state shown in FIG. 6, thereby moving the pressing mechanism 30 and the ratchet mechanism 40. In this case, the web 3 would not run. As a result, the cylinder 2 is pressed by pressing force F2 (150N) against the fixing roller 12. In addition, the restriction by the ratchet mechanism 40 is released, so that the cylinder 2 is allowed to rotate. Accordingly, the cylinder 2 is driven by the movement of the fixing roller 12.

As described, if the cylinder 2 is driven by the fixing roller 12 while being pressed to the fixing roller 12 by a pressing force of 150N and without running the web 3, it is possible to tremendously increase the area size of the web 3 in contact with the surface 12*a* of the fixing roller 12.

When the cleaning device 1 was moved in accordance to the second mode, the unfixed toner was completely cleaned by a two-round rotation of the fixing roller 12. After the cleaning device 1 is moved in accordance with the second mode, the motor 20 is slightly moved forward to thereby restrict the rotation of the cylinder 2 by the ratchet mechanism 40, and then, the motor 20 is moved backward to rewind the web 3 by the length corresponding to the outer periphery of the cylinder 2. The cleaning operation is stopped at this point. If this operation is performed, the unused web 3 can be faced to the surface 12*a* of the fixing roller 12 when the normal operation is initiated after overcoming the paper jam.

Figure 8:
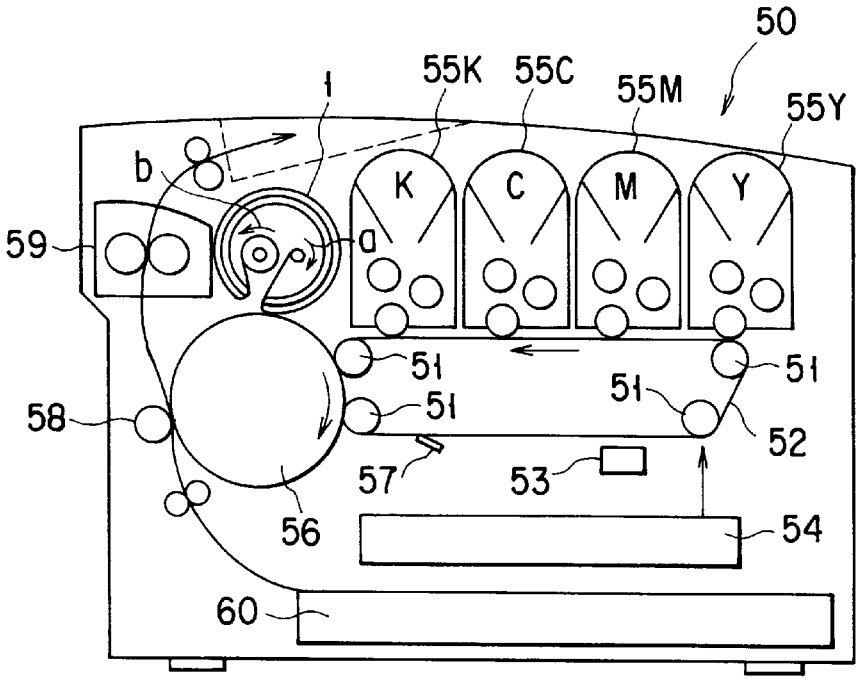
FIG. 8 is a schematic view showing an embodiment of the present invention in which the cleaning device of the present invention is arranged so as to face an intermediate transfer member of a color copy machine.

FIG. 8 shows an embodiment in which the cleaning device 1 of the present invention is arranged so as to face an intermediate transfer member 56 of a color copy machine 50. In this embodiment, although the cleaning device 1 is allowed to face the intermediate transfer member 56 instead of the fixing roller 12, the cleaning device 1 has the same function as in the aforementioned embodiment.

In virtually the middle portion of the color copy machine 50, a photosensitive endless belt 52 is stretched between a plurality of rollers 51. The running speed of the photosensitive belt 52, namely a processing speed of the copy machine, is set at 127 mm/s. Around the photosensitive belt 52, an electric charger 53, a light exposure unit 54, developing units 55Y, 55M, 55C, 55K, the intermediate transfer member 56, and a cleaning blade 57 are arranged sequentially along the running direction of the photosensitive belt 52. The electric charger 53 is responsible for charging the surface of the photosensitive belt 52 at a potential of 650 V. The light exposure unit 54 exposes the surface of the charged photosensitive belt to form an electrostatic latent image. The developing units 55Y, 55M, 55C, 55K develop the latent image by supplying color toners to the electrostatic latent image formed by the light exposure unit 54. The intermediate transfer member 56 superposes the toner images developed by the different developing units successively to transfer the images. The cleaning blade 57 scratches toners remaining on the photosensitive belt 52 without being transferred.

The intermediate transfer member 56 is formed of a conductive rubber roller having a carbon-mixed silicon rubber surface. The carbon-mixed silicon rubber is formed in a high-temperature vulcanization process. The intermediate transfer member 56 has an outer diameter of 189 mm. The surface layer has a volume resistivity of about $10^7$ Ω·cm. When the toner images formed on the photosensitive belt 52 are transferred, a voltage of about +1 KV is applied to the intermediate transfer member 56.

At the left-hand side of the intermediate transfer member 56 in the figure, a transfer roller 58 is separably arranged to the intermediate transfer member 56. The cleaning device 1 of the present invention is separably arranged in the upper proximity with the intermediate transfer member 56.

As described, color toner images of different colors are sequentially formed on the photosensitive belt 52 while the transfer roller 58 and the cleaning device 1 are separated from the intermediate transfer member 56, and then superposed on the intermediate transfer member 56.

First, the surface of the photosensitive belt 52 charged at a predetermined potential by the electric charger 53, is exposed to light by means of the light exposure unit 54 to form an electrostatic latent image for yellow on the surface of the photosensitive belt 52. The electrostatic latent image is developed by the development unit 55Y for yellow. The yellow toner image is transferred onto the surface of the intermediate transfer member 56. In this manner, toner images of different colors are successively superposed on the surface of the intermediate transfer member 56. Every time each of the toner images of different colors is transferred onto the intermediate transfer member 56, the toner remaining on the surface of the photosensitive belt 52 is cleaned off by the cleaning blade 57.

Subsequently, the transfer roller 58 and the cleaning device 1 are brought in contact with the intermediate transfer member 56 and then the paper sheet P is taken out from the cassette 60. Then the sheet P is transferred to a transfer nip between the intermediate transfer member 56 and the transfer roller 58 in exact timing upon superposing the toner images of different colors on the intermediate transfer member 56. In this way, a color image is transferred on the sheet P. The sheet P having the color image transferred thereon is subjected to the fixing device 59 to fix the color image transferred on the sheet P and discharged out of the machine.

In this case, the cleaning device 1 is operated in the same manner as in the aforementioned examples while being in contact with the surface of the intermediate transfer member 56.

More specifically, during the normal operation time, the cleaning device 1 is arranged to face the intermediate transfer member 56 in such a way that the opening edge 202 of the slit 2*a* of the cleaning device 1 is in the closest proximity with the intermediate transfer member 56. The web 3 is intermittently wound by the rotation of the rewinding shaft 6. In this case, the web 3 is designed to be wound in the opposite direction to the rotation direction of the intermediate transfer member 56.

On the other hand, when the paper jam takes place in the vicinity of the intermediate transfer member 56, the cleaning device 1 is operated either the first mode or the second mode.

In the first mode, it was possible to clean the unfixed toner attached on the surface of the intermediate transfer member 56 by wining the web 3 at a running speed of 5 to 200 mm/s for the time required for the intermediate transfer member 56 to rotate at least one round (about 4.68 sec).

In the second mode, while the movement of the web 3 is prohibited by applying a pressing force of 150N to the rotation shaft of the cylinder 2 to press the intermediate transfer member 56, the cylinder 2 was driven to rotate by the movement of the intermediate transfer member 56. As a result, the toner was completely cleaned by a single rotation of the intermediate transfer member 56.

As mentioned in the foregoing, if the cleaning device 1 of the present invention is arranged so as to face the intermediate transfer member 56, the same effect can be obtained as in the aforementioned embodiment.

The present invention is not limited to the embodiments mentioned above and may be variously modified within the scope of the present invention. In the aforementioned embodiments, there have been described the cases where the cleaning device 1 of the present invention is allowed to face to the fixing roller 12 and to the intermediate transfer member 56. However, the cleaning device 1 of the present invention may be arranged so as to face the photosensitive drum, the transfer belt of the copy machine, the pressurizing roller of the fixing device. In any case, good cleaning performance can be exhibited.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cleaning device comprising:

a cylindrical member having a slit extended in a shaft direction in an outer periphery thereof;

a cleaning member of a belt form wound around the outer periphery of the cylindrical member;

a feed-out shaft that extends in the shaft direction within the cylindrical member, having the cleaning member wound therearound and feeding out the wound cleaning member;

a rewind shaft extended in the shaft direction within the cylindrical member rewinding the cleaning member out from the feed-out shaft in a direction opposite to that of the feed-out shaft after the cleaning member is extended out of the cylindrical member through the slit, wound around the outer periphery of the cylindrical member, and introduced again into the cylindrical member through the slit;

a drive member that rotates the rewind shaft; and a belt member for slidably connecting the feed-out shaft and the rewind shaft and transferring a driving force generated upon rotation of the rewind shaft by the drive member to the feed-out shaft as a driving force working in a direction that is opposite to the rotational direction of the feed-out shaft.

2. The cleaning device according to claim 1, wherein the cylindrical member is rotated while the cleaning member wound around the outer periphery of the cylindrical member is pressed against an object to be cleaned.

3. The cleaning device according to claim 1, wherein rotation of the cylindrical member is prohibited while the cleaning member wound around the periphery of the cylindrical member is pressed against an object to be cleaned, and the rewind shaft is an object to be cleaned; and rotating means for rotating the rewind shaft to rewind the cleaning member and moving the cleaning member pressed against the object to be cleaned by the pressing means.

4. The cleaning device according to claim 3, wherein the cylindrical member is positioned so that an edge of the slit located at a side, through which the cleaning member is wound by the rewind shaft, faces in a close proximity with the object to be cleaned.

5. A cleaning device comprising:

a cylindrical member having a slit extended in a shaft direction in an outer periphery thereof;

a cleaning member of a belt form wound around the outer periphery of the cylindrical member;

a feed-out shaft that extends in the shaft direction within the cylindrical member, having the cleaning member wound therearound, and feeding out the wound cleaning member;

a rewind shaft extended in the shaft direction within the cylindrical member rewinding the cleaning member fed out from the feed-out shaft in a direction opposite to that of the feed-out shaft after the cleaning member is extended out of the cylindrical member through the slit, wound around the outer periphery of the cylindrical member, and introduced again into the cylindrical member through the slit;

a pressing element that urges the cylindrical member in a direction of an object to be cleaned so that the cleaning member, which is wound around the outer periphery of the cylindrical member, is pressed against the object to be cleaned; and a rotating element that rotates the rewind shaft to rewind the cleaning member and moves the cleaning member, which is pressed against the object to be cleaned by the pressing element.

6. The cleaning device according to claim 5, wherein the pressing element urges the cylindrical member against the object to be cleaned by either a first pressing force or a second pressing force which is larger than the first pressing force.

7. The cleaning device according to claim 5, wherein the rotating element rotates the rewind shaft intermittently to rewind the cleaning member intermittently.

8. The cleaning device according to claim 5, wherein the rotating element rotates the rewind shaft continuously to rewind the cleaning member continuously.

9. A cleaning device comprising:

a cylindrical member having a slit extended in a shaft direction in an outer periphery thereof;

a cleaning member of a belt form wound around the outer periphery of the cylindrical member;

a feed-out shaft that extends in the shaft direction within the cylindrical member, having the cleaning member wound therearound, and feeding out the wound cleaning member;

a rewind shaft extended in the shaft direction within the cylindrical member rewinding the cleaning member fed out from the feed-out shaft in a direction opposite to that of the feed-out shaft after the cleaning member is extended out of the cylindrical member through the slit, wound around the outer periphery of the cylindrical member, and introduced again into the cylindrical member through the slit;

a pressing element that urges the cylindrical member in a direction of an object to be cleaned so that the cleaning member, which is wound around the outer periphery of the cylindrical member, is pressed against the object to be cleaned;

a rotation prohibiting element that prevents rotation of the cylindrical member, which is pressed against the object to be cleaned by the pressing element, to align the cylindrical member with the object to be cleaned; and a rotating element that rotates the rewind shaft to rewind the cleaning member and moves the cleaning member, which is pressed against the object to be cleaned by the pressing element.

10. The cleaning device according to claim 9, wherein the pressing element urges the cylindrical member against the object to be cleaned by either a first pressing force or a second pressing force which is larger than the first pressing force.

11. The cleaning device according to claim 9, wherein the rotating element rotates the rewind shaft intermittently to rewind the cleaning member intermittently.

12. The cleaning device according to claim 9, wherein the rotating element rotates the rewind shaft continuously to rewind the cleaning member continuously.

13. The cleaning device according to claim 9, wherein the rotation prohibit element stops rotation of the cylindrical member at an edge of the slit which is located near a position through which the cleaning member wound around the outer periphery of the cylindrical member is rewound by the rewind shaft, faces in a close proximity with the object to be cleaned.

14. The cleaning device according to claim 13, wherein the rewind shaft is rotated intermittently by the rotating element while rotation of the cylindrical member is prohibited by the rotation prohibiting element thereby moving the cleaning member intermittently.

15. The cleaning device according to claim 9, wherein a cleaning operation is performed in accordance with either a first mode in which the cleaning member is continuously moved by continuously rotating the rewind shaft by the rotating element while rotation of the cylindrical member is prohibited by the rotation prohibiting element and the cylindrical member is pressed against the object to be cleaned by the pressing element using a first pressing force; or a second mode in which the cylindrical member is allowed to rotate by releasing a restriction imposed by the rotation prohibiting element while the cylindrical member is pressed against the object to be cleaned by a second pressing force larger than the first pressing force.

16. The cleaning device according to claim 15, wherein the cleaning member is rewound by at least a length corresponding to an outer peripheral portion of the cylindrical member by rotating the rewind shaft by the rotating element while rotation of the cylindrical member is prohibited by the rotation prohibiting element after completion of a cleaning operation in accordance with the second mode.

* * * * *